US009540914B2

(12) United States Patent
Manin

(10) Patent No.: US 9,540,914 B2
(45) Date of Patent: Jan. 10, 2017

(54) WATER FRACTION MONITORING TECHNIQUE

(71) Applicant: Schlumberger Technology Corporation, Sugar land, TX (US)

(72) Inventor: Yves Manin, Le Plessis-Robinson (FR)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 131 days.

(21) Appl. No.: 14/490,934

(22) Filed: Sep. 19, 2014

(65) Prior Publication Data

US 2015/0083402 A1 Mar. 26, 2015

(30) Foreign Application Priority Data

Sep. 23, 2013 (EP) ..... 13306299

(51) Int. Cl.
*E21B 47/06* (2012.01)
*E21B 43/14* (2006.01)
*E21B 47/10* (2012.01)

(52) U.S. Cl.
CPC ..... *E21B 43/14* (2013.01); *E21B 47/06* (2013.01); *E21B 47/10* (2013.01)

(58) Field of Classification Search
CPC ..... E21B 43/00; E21B 47/10; E21B 47/06; E21B 49/008; E21B 49/00; E21B 43/14; E21B 43/32; E21B 43/12; E21B 47/00; E21B 47/0007
See application file for complete search history.

(56) References Cited

U.S. PATENT DOCUMENTS

2014/0137643 A1* 5/2014 Henry ..... E21B 21/063 73/152.31

* cited by examiner

*Primary Examiner* — Zakiya W Bates
(74) *Attorney, Agent, or Firm* — Cameron R. Sneddon

(57) ABSTRACT

A method and system for estimating water cut or water fraction. The method may include independently establishing a production index for a region in a well. An initial flow rate in the region may be computed from the production index. Further, a measured flow rate may also be monitored within the region on an ongoing rate, for example, with a Venturi device. Thus, a comparison of the initial and measured flow rates may also take place on an ongoing basis so as to provide a real time read of fluid density. This, in turn may be used to estimate water cut of anywhere between 0 and 100% for the region in a dynamic manner. As a result, production from the overall well may be optimized with greater accuracy as a determination on the amount of production allowed, if any, is made on a region by region basis with improved water cut accuracy regarding each region.

20 Claims, 5 Drawing Sheets

WATER FRACTION MONITORING TECHNIQUE

BACKGROUND

Exploring, drilling and completing hydrocarbon and other wells are generally complicated, time consuming and ultimately very expensive endeavors. In recognition of these expenses, added emphasis has been placed on efficiencies associated with well completions and maintenance over the life of the well. Further, ever increasing well depths and sophisticated architecture are also employed for the sake of maximizing the efficiency and total hydrocarbon recovery from a given hydrocarbon reservoir. For example, vertical well depth may exceed 10,000 feet in order to reach deep reservoirs as well as to help ensure maximum vertical contact with the reservoir.

Of course, even maximum vertical contact with the reservoir is limited given that the reservoir, as with most any other geologic formation, is found in a layered fashion. For example, it would not be uncommon to find a reservoir that occupies about 100 feet vertically, but tens of thousands of feet horizontally. As a result, well architecture often includes a cased vertical well section that extends into an open-hole horizontal or lateral leg section. In fact, the main bore of the well may vertically traverse the reservoir with several lateral legs emerging therefrom and going in different horizontal directions through the reservoir.

Not only does each horizontal leg add to the amount of contact with the reservoir, each leg may add dramatically to the amount of contact. For example, even in the noted circumstance where the well may afford 100 feet of vertical contact to the main bore, each lateral leg may extend to 10,000 feet or more horizontally through the reservoir. Thus, where perhaps five such horizontal legs emerge from the main bore in this fashion, 50,000 feet of added contact surface with the reservoir is provided by way of these legs. In a case where each of the legs is about the same diameter as the main vertical bore, this means that about 500 times the amount of interface with the reservoir has been provided by way of the legs as compared to the main bore.

Of course, with tens of thousands of feet of added well space provided by horizontal legs as described above, tens of thousands of feet of added well maintenance and management is required. For example, production from the reservoir may change over time and contaminants, often water, may begin to be produced. However, it is unlikely that water will suddenly be produced from all regions of the horizontal legs simultaneously. Rather, water production is likely to emerge inconsistently at isolated locations of one horizontal leg or another. Nevertheless, because each horizontal leg emerges from the same main bore, water production at a single location of a single horizontal leg may adversely affect all of production operations. Stated another way, the dramatic increase in reservoir contact area afforded by the horizontal legs has also dramatically increased the likelihood of water production with the potential to affect production operations.

In order to address the possibility of water production from a single location adversely affecting all production operations in a well of multilateral architecture as described, each leg is generally compartmentalized into zonally isolated regions. For example, the architecture of a 10,000 foot leg may be zonally isolated into five separate 2,000 foot sections. In this way, each section may be monitored throughout production operations for water production. Thus, once sufficient water production is detected at one of the sections, production therefrom may be closed off or reduced, for example, by closing a sliding sleeve or valve actuated by surface control or through an intervention if necessary.

The ability to detect water production and independently close off production, section by section as noted above, generally involves the placement of a dedicated capacitance measurement tool within each section. Each tool may be provided with the ability to communicate with equipment at the oilfield surface. So, for example, where water production is detected by the tool within the third section of the second lateral leg, the operator at the surface of the oilfield is provided with such information and may take appropriate corrective action (e.g. to direct closing of a sliding sleeve in the section to stop production therefrom). As a result, production from all other sections of the second leg and all other legs may proceed unaffected by any water production from the now closed off section.

Unfortunately, the ability to detect true water production or an accurate "water cut" by a conventional capacitance measurement tool is limited. Specifically, the amount of water that is being produced as compared to the totality of the produced fluid may not be ascertained with a great degree of accuracy, particularly where the water cut exceeds about 25-30%. That is, once the water being produced exceeds 25-30% of the produced fluid, the readings obtained from a capacitance measurement tool will continue to show only a 25-30% cut, even though the actual cut may be 35-80% or more.

Often, the inability to detect the true water cut is not of major concern. For example, it may be desirable to close off all production from a section whenever water production exceeds about 10%. Thus, the inability to accurately ascertain a 55% cut, for example, is of no significance. However, this is not always the case as many times it is desirable to know the true water cut even if well over 30%.

In wells such as those described hereinabove where an extensive amount of interface with the reservoir takes place in through horizontal legs, the true cut value over 30% is likely to be of significance. In multilaterals such as these, water cut may exceed 30% but only in an intermittent fashion. That is, the horizontal architecture may serve to promote a phase separation between water and hydrocarbons such that surges of water emerge periodically. Thus, the detection of water may not actually be an indication that the entire section being monitored has transitioned to an overall state of high water production. Instead, it may merely be that a temporary surge of water is detected as a result of the well architecture. Of course, the significance of such a temporary surge is unknown if the operator is never made aware of whether the water cut from the surge is 30%, 100%, or some other value in between. As a result, the operator may be left to assume a 100% water cut whenever the cut detection is over 30%. This may in turn lead to prematurely and unnecessarily closing off the leg section. In fact, given that the well is multilateral in nature, this natural phase separation problem is likely to be repeated at several different sections of the well. Therefore, a dramatic reduction in the overall productivity and efficiency of the well may take place as a multitude of well sections are prematurely closed off due to the unavailability of true water cut data in excess of about 30%.

SUMMARY

A method of estimating water cut in a region of a well during well operations is provided. The method may include establishing a production index for the region and computing an initial flow rate in the region from the production index. A measured flow rate may then be monitored with a Venturi device. Comparison of the initial and measured flow rates may be tracked on an on-going basis to provide a dynamic read of fluid density. Thus, water cut between 0 and 100% may be estimated for the region over the course of operations.

DETAILED DESCRIPTION

Embodiments are described with reference to certain downhole hardware and architecture. Specifically, the embodiments depict a multilateral well with a variety of horizontal legs divided into multiple isolated production regions. However, any number of different types of downhole architecture may benefit from embodiments of a system and/or technique of monitoring water cut as detailed herein. For example, even operations at a strictly a vertical well may benefit from the enhanced monitoring and optimization afforded by the water cut monitoring system and techniques described herein. Indeed, so long as water cut estimates across an entire range of 0-100% are available for sake of optimizing production, appreciable benefit may be realized.

Figure 1:
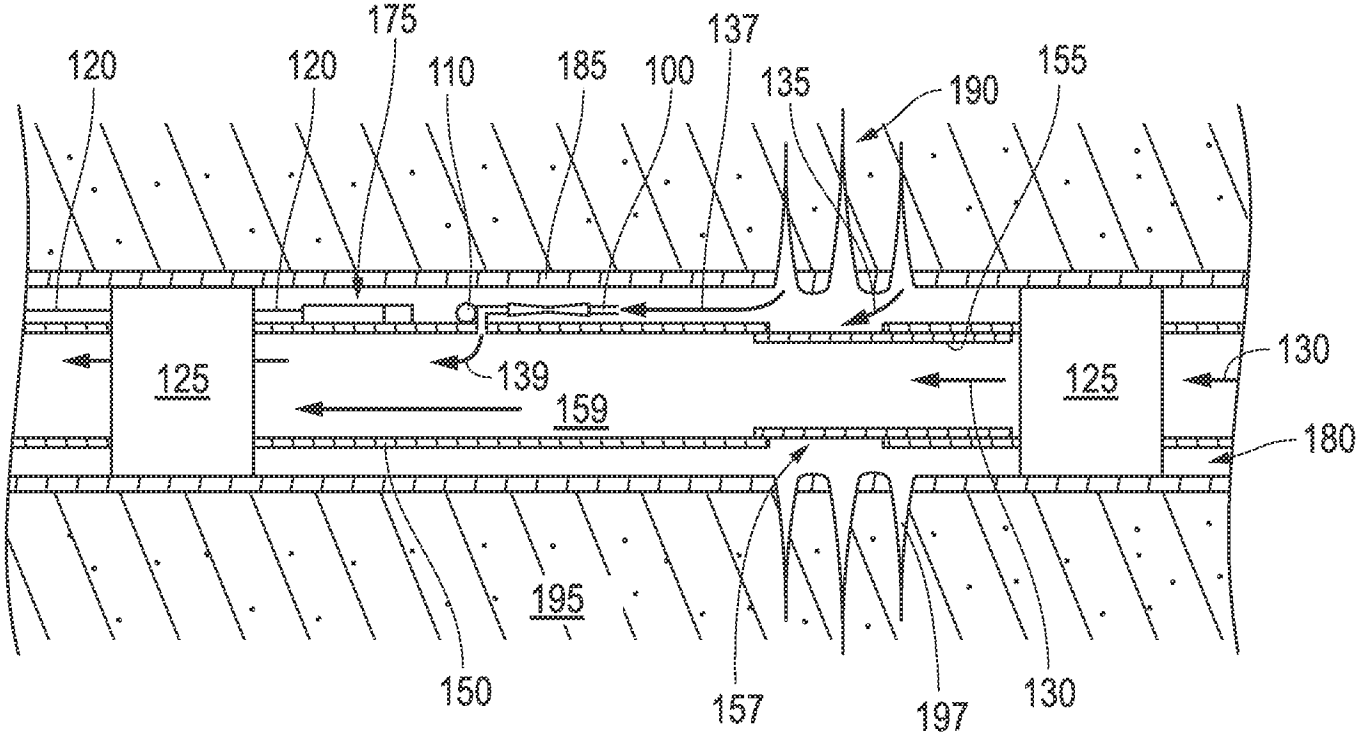
FIG. 1 is a side cross-sectional view of a region of a horizontal leg of a well having an embodiment of a water cut monitoring system incorporated thereinto.

Referring now to FIG. 1, a side cross-sectional view of a region of a horizontal leg of a well 180 is shown. The region is isolated between packers 125 having production tubing 150 running therethrough. So, for example, in the embodiment shown, the well 180 and region may be defined by casing 185 having perforations 197 that penetrate into a surrounding formation 195. Thus, a production area 190 of the formation 195 may be accessible by the isolated region. In the embodiment shown, the production tubing 150 is provided with a potential intake opening 157 for the uptake of additional production fluids 135 from the production area 190 of the formation 195. Whether or not to open the opening 157 may be determined by readings from a water cut monitoring system as detailed further below. Additionally, other fluids 130 from further downhole and outside of the region may flow up through the channel 159 of the production tubing 150.

As alluded to above, the depicted hardware is outfitted with an embodiment of a water cut monitoring system. That is, in order to ensure that the percentage of water in the production fluid 135 from the area 190 and region are not over a predetermined acceptable level, the depicted hardware of the region includes a system for monitoring the fluid 135 in this regard. Specifically, the system for the isolated region includes a capacitance tool 110 that interfaces with the fluid 135 in order to provide a fairly accurate measure of water cut or water fraction. In the embodiment shown, the tool 110 is shown adjacent to a Venturi device 100 for communication with fluid therein. However, in other embodiments, the tool 110 may actually be disposed within the device 100 itself. Further, in yet another embodiment, a water cut measurement sensor other than an installed capacitance tool may be utilized to obtain the initial water cut. For example, a more temporary sensor introduced to the region via wireline intervention may be utilized to obtain initial water cut measurements.

Regardless, so long as the percentage of water in the fluid 135 is below about 25-30%, a conventional tool such as the depicted capacitance tool 110 may reliably provide such water cut information. Once more, at the outset of production operations, the water cut is unlikely to be significant enough to render the tool 110 ineffective. Nevertheless, given the possibility of water cut increasing over the life of the well 180 or perhaps in surges or "slugs" as a result of the well architecture, the system is also outfitted with additional features to allow continued reliable monitoring of water cut even at levels above 30%.

Continuing with reference to FIG. 1, the system also includes a flow-meter in the form of a Venturi device 100 as indicated above. Thus, an intake stream 137 of the production fluid 135 may be routed through the device 100 where flow and other measurements may be ascertained as described further below. The device 100 may simultaneously provide a return stream 139 to the main channel 159 of the production tubing 150 for continued advancement uphole. Readings and computations available from use of the device 100 in combination with the capacitance tool 110, allow for continued real-time monitoring of water cut even in ranges exceeding 30%. Indeed, a full range of water cut estimates (i.e. between 0-100%) may be ascertained through use of the system described herein.

In FIG. 1, telemetry 120 and electronics packaging 175 are also provided as part of the system. The telemetry 120 may be a power and communications line. Alternatively, some degree of power may be available via a downhole power source of the packaging 175. Regardless, fluid characteristic readings from both the capacitance tool 110 and Venturi device 100 may be managed and relayed by such features 120, 175 to equipment at an oilfield surface adjacent the well 180. Thus, operators with access to such equipment may make decisions at the oilfield geared toward optimizing overall well production. So, for example, where computations based on the system readings indicate that water production from the depicted region is higher than should be allowed based on preset parameters, an operator may move to close off production from the region. Such optimizing may involve the operator directing closure of the intake through the Venturi device 100 and ensuring that the sliding sleeve 155 remains either partially or completely closed so as to effect the amount of fluid uptake through the opening 157. In this way, production from the region depicted may be minimized or eliminated due to the emergence of water. However, production from elsewhere (i.e. fluid flow 130) may continue to pass through the region via the channel 159.

It is of note that the system of FIG. 1 is made up of available downhole components that are uniquely employed together for embodiments detailed herein. For example, a Venturi device 100 as shown may generally be utilized for providing flow rate information in downhole environments. However, in the particular embodiment of FIG. 1, this device 100 is now utilized in combination with a capacitance tool 110 to provide measurements that will allow for previously unavailable estimates of water cut beyond 30% and even up to 100%.

Figure 2A:
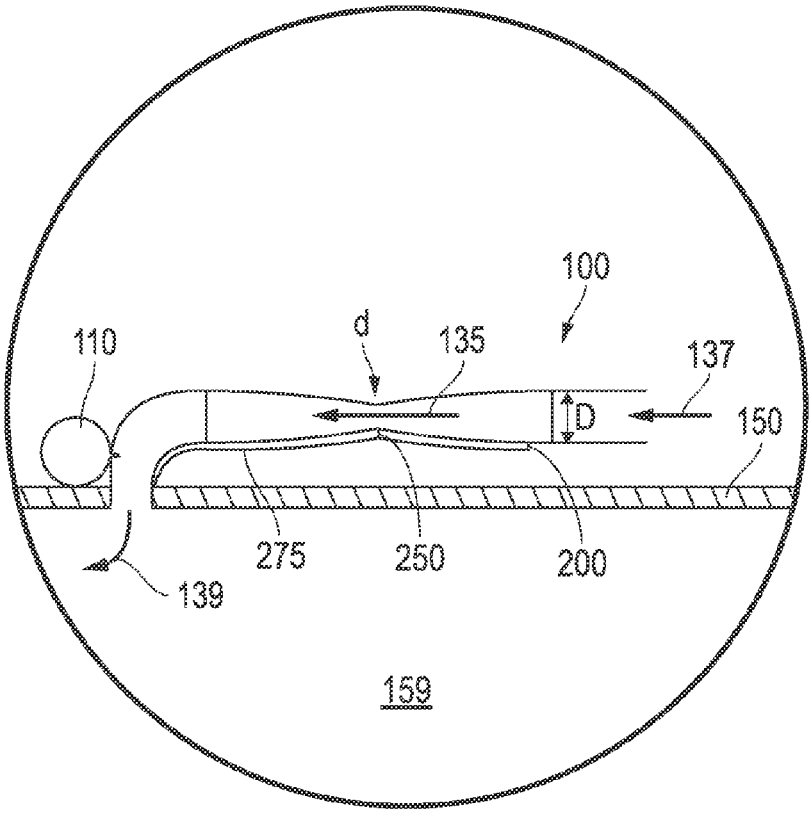
FIG. 2A is a side cross-sectional view of a Venturi device of the water cut monitoring system of FIG. 1.

Referring now to FIG. 2A, a side cross-sectional view of the Venturi device 100 of the system of FIG. 1 is shown as an aid to illustrating how water cut estimates across an entire range of between 0 and 100% may be determined. This is done with reference to a productivity index (PI). The PI is generally considered an indication of the production potential of a well. Specifically, PI is the flow rate (Qv) per unit pressure drop of the well draw down pressure (ΔPw) as obtained in part by the Venturi device 100. Specifically, this pressure (ΔPw) may be obtained by measuring a flowing fluid 137 pressure, such as at the sensor 200 of FIG. 2A, which is then subtracted from a known reservoir pressure. For example, the equation for PI may be referenced as follows:

$$PI_{(0-30\%)} = \frac{Qv}{\Delta Pw}$$

For embodiments herein, as an initial measure, the PI may be established by the device 100 at a time when the water cut is of a known value of below about 30% (e.g. as reliably verified by the capacitance tool 110). Thus, the equation above properly notes a PI at 0-30%. By way of real world example for sake of illustration only, there may be a known flow rate of 1,000 barrels per day and a 1,500 PSI flowing pressure detected by the device 100 in a well that is known to have a reservoir pressure of 2,000 PSI. In such a circumstance, the PI would be 2 (i.e. 1,000/(2,000−1,500)).

Given that the PI was determined at a time when the water cut was of a known level, a reliable value for the PI may continue to be used to ultimately determine the density of the flowing fluid 135 at any given point in time. That is, as the density of the fluid 135 changes, due to water cut increasing up to and beyond 30%, the PI value may be presumed to remain substantially constant. Thus, as described further below, the unknown variable of density may ultimately be solved with reference to a presumed PI in combination with detections from the device 100.

As alluded to above, with a reliably known PI in hand, the flow rate for an entire time period, irrespective of actual water cut, may be determined by the following equation:

$$Q^*_{(0\text{-}100\%)} = PI_{(0\text{-}30\%)} \cdot \Delta Pw$$

That is, a flowrate across an entire range (i.e. Q*) may be computed with reference to the presumably constant PI and the pressure drop (ΔPw) as described above. Again, by way of specific example only, this means that where a pressure drop of 500 is again detected, the flowrate will remain 1,000. However, over the time period at issue, the pressure drop may fluctuate. Nevertheless, as opposed to guesswork along these lines, the determined flowrate over the period in question may be used to compute fluid density over the same period such that an actual water cut estimate may be made, again, irrespective of the level of water cut (i.e. even if over 30%). With reference to the initial productivity index (PI) variables introduced above, an equation for such determinations may be represented as follows:

$$Qv = C \cdot \sqrt{\frac{\Delta Pv}{\rho}}$$

In this case, the flowrate (Qv) for any given point in time is already established along the lines indicated above. However, with added reference to FIG. 2A, the determination of the pressure drop (ΔPv) here may be obtained by the difference in pressure of the fluid flow 137 as between upstream pressure (i.e. at sensor 200) and the pressure at the throat of the Venturi device 100 (i.e. at sensor 250). Thus, at any given point in time a value is available for both the flowrate and the pressure drop.

Additionally, the discharge coefficient (C) is a constant that is based on the dimensions of the Venturi device 100, generally with a value of just under 1. For example, the discharge coefficient (C) may be between about 0.90 and 0.99. This means that only the density (ρ), a direct measure of water cut, need be computed for any given point in time. Specifically, an equation solving for the density at any given point in time may be presented as follows:

$$\rho_new = \left(\frac{C}{Q^*}\right)^2 \cdot \Delta Pv$$

Figure 2B:
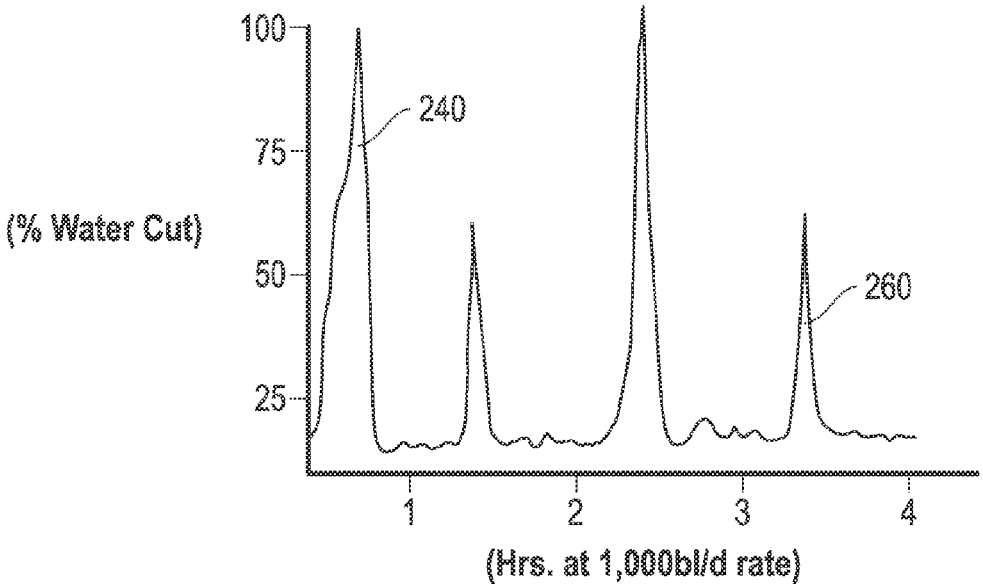
FIG. 2B is a chart depicting water cut computations available from measurements of the system of FIG. 1 over a period of time at a given flow rate of fluid through the region.

As indicated above the pressure drop (ΔPv) here may be obtained via ongoing dynamic readings available directly from sensors 200, 250 of the Venturi device 100. Further, the flowrate (Q*) is again presumed across an entire range of water cut. This means that the water cut, as indicated by computed density (ρ), may be plotted over a period of time, for example as depicted in the chart of FIG. 2B. However, continuing with the depiction of FIG. 2A for a moment, the noted coefficient (C) may be determined with reference to the dimensions of the Venturi device 100 as alluded to above. More specifically, this constant (C) may be a stored value at a processor of surface equipment for managing the computing of other values as detailed hereinabove.

With specific reference to the device 100 of FIG. 2A, the pressure values for the computations detailed above may be obtained as the intake stream 137 of fluid 135 from the reservoir enters the device 100 and traverses a narrowing neck thereof. In the embodiment shown, the device may have a neck diameter (d) of between about 0.25 inches and about 0.5 inches whereas the inlet and outlet diameters (D) are upwards of an inch or more. Pressure readings may be taken from an upstream sensor 200 as well as a downstream or neck sensor 250 as indicated above. Thus, the above noted pressure drop (ΔPv) may be computed once such readings are relayed over a device line 275 and to a processor as indicated above.

Referring now to FIG. 2B, a chart is shown depicting an example of water cut computations available from measurements of the system. That is, with a system supporting computations as described above, each individual region may be monitored for actual water cut. Specifically, the chart of FIG. 2B, shows the practical results of such monitoring and computations over a period of time at a given flow rate of fluid through the region being monitored.

In FIG. 2B, it is apparent that the water cut, or percentage of water in the producing fluids of the region, tend to spike in periodic surges or "slugs" for the several hours being monitored. As alluded to above, this type of water production is often found as a result of natural phase separating that takes place within horizontal well regions. Nevertheless, by employing the system and techniques detailed herein, the operator is also provided with an understanding of truly how much water is being produced. For example, in certain circumstances, the water cut above 25-30% truly does reach 100% (see 240). However, in other circumstances, the water cut above 25-30% might only rise slightly above 50% (see 260). Furthermore, in the particular example of FIG. 2B, all of the slugs of water reach a peak that persists only for a brief moment as opposed to the lasting for the duration of the surge as measured along the x-axis.

This type of information of level of detail may substantially enhance the operator's ability to optimize production. That is, in absence of the system and techniques detailed herein, the operator may be deciding whether to allow a region to continue to produce based on the assumption that every surge of over 25-30% reaches 100% (and for the entirety of the surge). Of course, this is an unlikely circumstance. However, rather than leaving the operator to blindly optimize based on uncertain likelihoods, the present system and techniques allow the operator to estimate true water production for the period being monitored. Ultimately, with brief added reference to FIGS. 4A-4B, this means that the operator is provided with true water cut estimates that allow for the tailoring of production region by region to optimize overall production.

Figure 3:
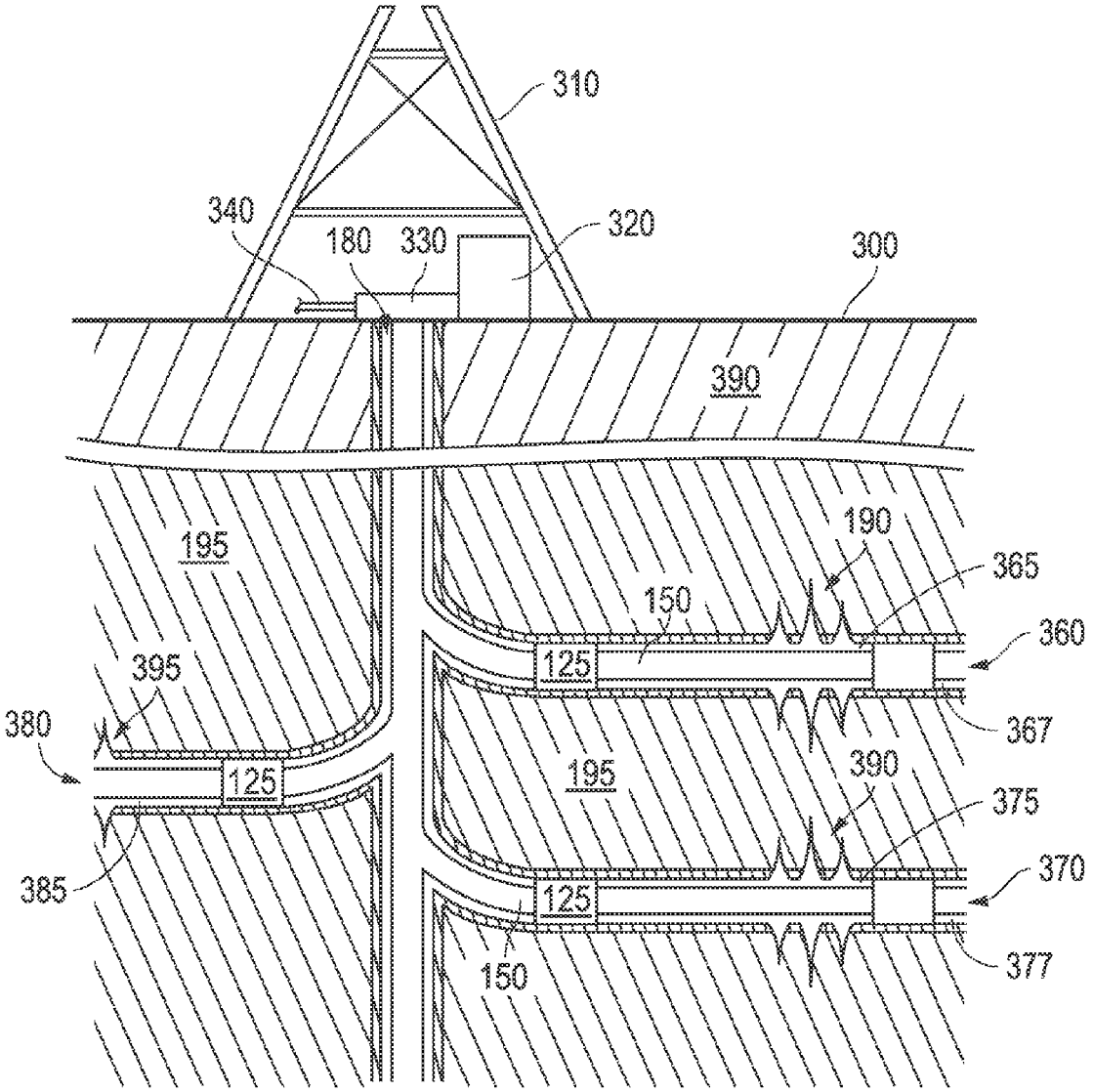
FIG. 3 is an overview of an oilfield accommodating the well with horizontal leg of FIG. 1 as part of an overall multilateral architecture for the well.

Referring now to FIG. 3, an overview of an oilfield 300 is shown accommodating the well 180 to be optimized in terms of production as noted above. The well 180 traverses multiple formation layers 390, 195 and the multilateral architecture is apparent with production tubing 150 reaching into several lateral or horizontal legs 360, 370, 380. Further, each leg 360, 370, 380 may have multiple production regions 365, 367, 375, 377, 385. Each of these regions 365, 367, 375, 377, 385 may be isolated by packers 125 and independently supplied by a dedicated production area 190, 390, 395 of perforations into the surrounding formation 195. Thus, the benefit of having true water cut estimates available for each and every region 365, 367, 375, 377, 385 is apparent. That is, optimization may be enhanced for the entire well 180 if the operator at the oilfield surface 300 is able to turn off or minimize production from any given region 365, 367, 375, 377, 385 as determined based on actual available water cut estimates for each region 365, 367, 375, 377, 385.

Continuing with reference to FIG. 3, computations for establishing or estimating a true water cut for each region 365, 367, 375, 377, 385, may take place at a control unit 320 at the oilfield surface 300. In the embodiment shown, equipment and hardware at the oilfield 300 include the control unit 300 positioned adjacent a well head 330 with a production line 340 emerging therefrom and a supportive rig 310 positioned thereover. Of course, the control unit 320 may be located elsewhere and a variety of different or additional surface equipment provided. Further, in one embodiment, the computations for establishing water cut may be processed at a downhole location as opposed to first being relayed uphole to surface equipment such as the control unit 320. Regardless, the operator is provided with a new reliable manner of optimizing production based on dedicated water cut estimates for each region 365, 367, 375, 377, 385, even where the cut exceeds 25-30%.

Figure 4A:
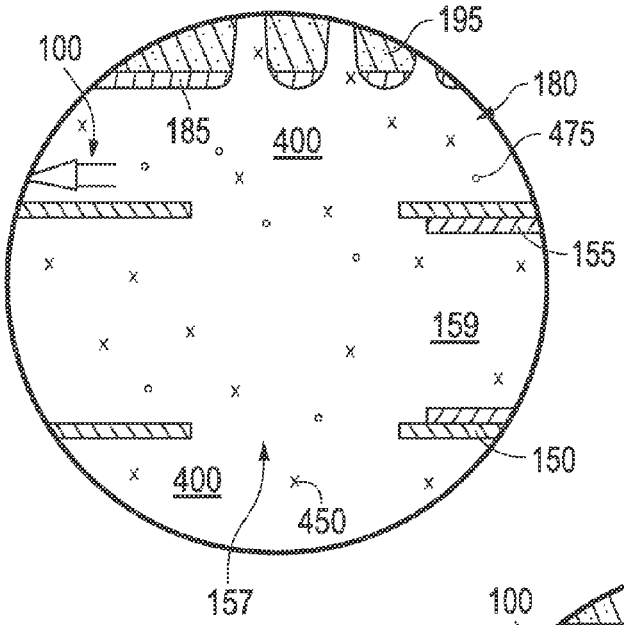
FIG. 4A is an enlarged view of a production location for the region of FIG. 1 where an intake opening is enlarged as the system has indicated an acceptable level of water in production fluids from the region.
Figure 4B:
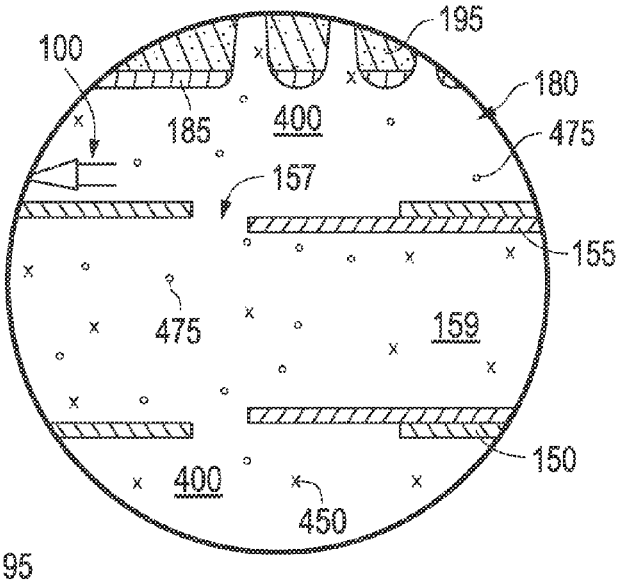
FIG. 4B is an enlarged view of the production location for the region of FIG. 1 where an intake opening is kept at a minimum as the system indicates a less desirable level of water in production fluids from the region.
Figure 4C:
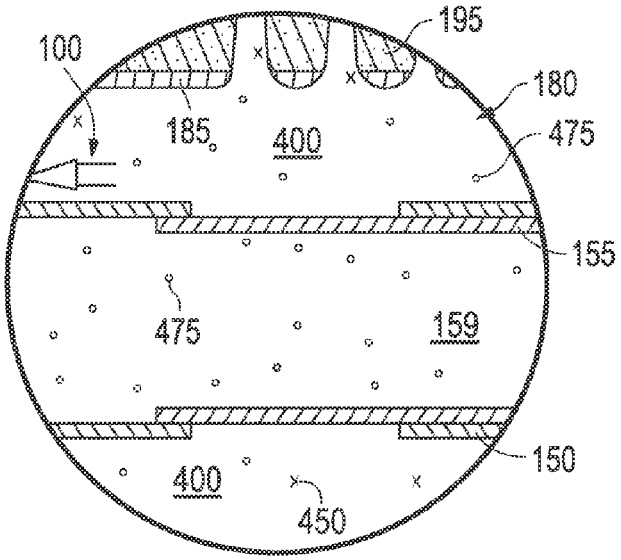
FIG. 4C is an enlarged view of the production location for the region of FIG. 1 where the system has indicated an unacceptable level of water in production fluids from the region and production is closed off.

Referring now to FIGS. 4A-4C, enlarged views of a location 400 of the region of FIG. 1 are shown which vary in terms of the percentage of hydrocarbons 450 and water 475 being produced from the adjacent formation 195. For example, in FIG. 4A, the system 100 and techniques detailed herein, indicate an acceptable level of water 475 in the overall production from the region. With added reference to FIG. 1, readings and computations have taken place with fluid initially directed exclusively through the Venturi device 100 to determine the acceptable level of water 475. Thus, the sliding sleeve 155 of the production tubing 150 may be moved to a fully opened position to increase production through the opening 157. Of course, in other embodiments, production may continue to take place exclusively through the Venturi device 100. In such embodiments, the device 100 may be sized and configured for such production intake and no alternative opening 157 provided.

With the sliding sleeve 155 closed or not present readings may also be acquired by the system that do not support maximizing production from the region. For example, with reference to FIG. 4B, the system 100 may acquire readings that indicate a higher degree of water 475 production. Thus, the sleeve 155 may be repositioned to limit uptake through the opening 157. In one embodiment, the sleeve 155 may be entirely closed as shown in FIG. 4C so as to limit the entirety of production to fluids through the Venturi device 100. Once more, continuing with reference to FIG. 4C, the degree of water 475 production may exceed a predetermined level which leads to closing the sleeve 155 as noted as well as closing a valve within the device 100 such that all production from the region is entirely eliminated.

It is notable that where the system 100 and techniques detailed hereinabove are utilized to close off or restrict production in the manner described above, the optimization has taken place with true water cut estimates available across a complete range of 0-100%. Additionally, while the above described manner of closing off production involved closing sliding sleeves, other well architecture may be utilized for independent closing off or restriction production on a region by region basis.

Figure 5:
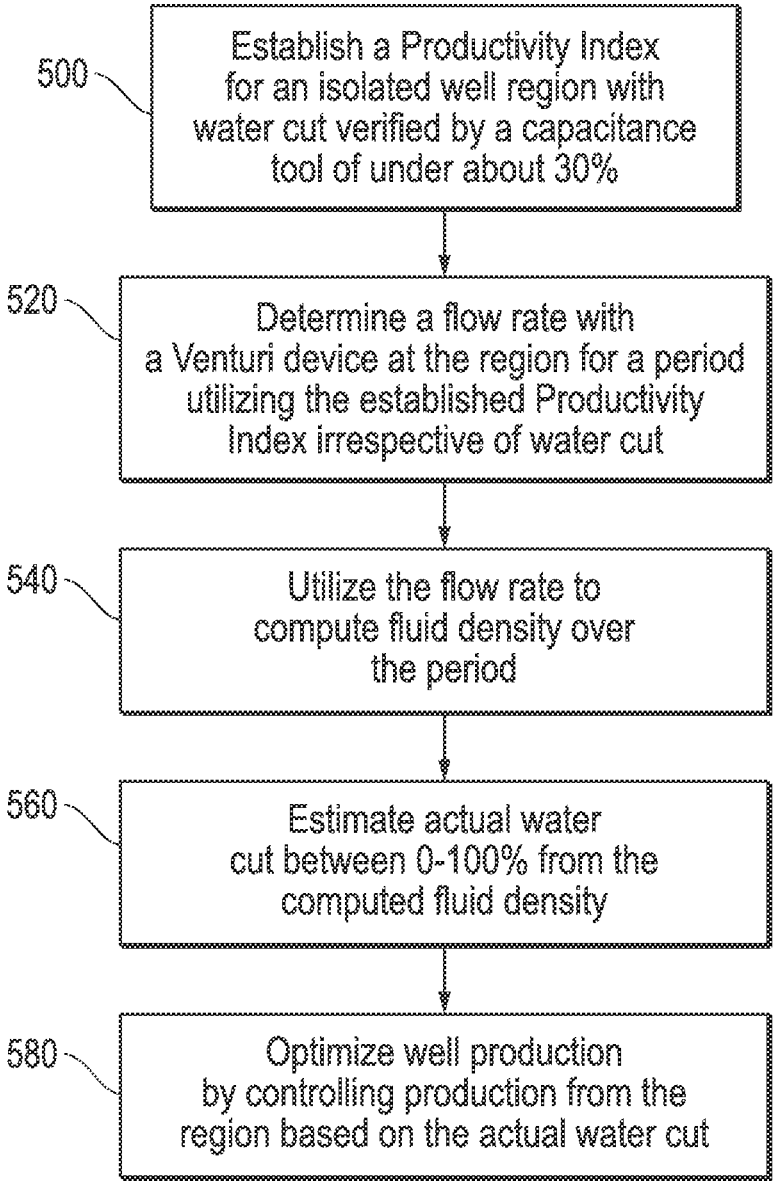
FIG. 5 is a flow-chart summarizing an embodiment of utilizing a water cut monitoring system to dynamically track water cut over a full 0-100% range in a flowing well over time.

Referring now to FIG. 5, a flow-chart is shown which summarizes an embodiment of utilizing a water cut monitoring system to dynamically track water cut over a full 0-100% range in a flowing well over time. Namely, a productivity index (PI) is established for an isolated well region at a time when water cut is verifiably below about 30% as determined by a capacitance tool (see 500). Thus, as indicated at 520, a flow rate may be determined for a period with a Venturi device at the region that is based on the established PI, irrespective of the water cut. As a result, fluid density over the period may be calculated as indicated at 540.

With the above computation of fluid density available over the period, actual water cut over an entire range of 0-100% may be estimated as indicated at 560. Accordingly, as noted at 580, well production may be optimized by controlling production from the region in question based on the actual water cut thereat.

Embodiments described hereinabove include embodiments of water cut or water fraction techniques and systems that allow for the monitoring of a true water cut value of over 30% in a flowing well. That is, in contrast to conventional systems and techniques, embodiments herein allow for the estimating of the water cut over a full 0-100% range. Thus, even in wells of complex architecture, including multiple horizontal legs which are prone to develop water surges or "slugs", the true water cut may be monitored in real time. As a result, a more accurate read on water cut for each region of the well that is independently monitored may be obtained. Therefore, production for the overall well may be optimized with a greater degree of precision as production from each well region is independently controlled based on the enhanced read of water cut for the region.

The preceding description has been presented with reference to presently preferred embodiments. Persons skilled in the art and technology to which these embodiments pertain will appreciate that alterations and changes in the described structures and methods of operation may be practiced without meaningfully departing from the principle, and scope of these embodiments. For example, applications outside of the oilfield environment may take advantage of water fraction techniques as detailed herein, wherever a conduit producing fluids of varying types is to be employed. Additionally, even within the oilfield environment, applications aside from hydrocarbon production may utilize such techniques, such as those involving intelligent completions in advance of production. Furthermore, the foregoing description should not be read as pertaining only to the precise structures described and shown in the accompanying drawings, but rather should be read as consistent with and as support for the following claims, which are to have their fullest and fairest scope.

The invention claimed is:

1. A method of estimating water cut over a range of 0-100% in an isolated region of a well during well operations, the method comprising:

verifying an initial water cut at a level of under about 30% for the region with a water cut measurement sensor;

establishing a productivity index for the region with the verified initial water cut available;

computing a flow rate in the region for a period from the established productivity index irrespective of water cut;

determining fluid density in the region over the period from the computed flow rate in the region over the period; and utilizing the fluid density over the period to estimate the water cut over the period across the 0-100% range.

2. The method of claim 1 wherein the estimating of the water cut over the range of 0-100% enhances one of decipherability of actual level of water cut over 30% and actual duration of water cut for any value exceeding 30%.

3. The method of claim 1 wherein establishing the productivity index comprises:

determining a known pressure of the well;

ascertaining a flow rate of well fluid in the region;

detecting a flowing fluid pressure in the region with a Venturi device therein;

subtracting the detected flowing fluid pressure from the known pressure of the well to obtain a pressure drop difference therebetween; and dividing the ascertained flow rate by the pressure drop difference.

4. The method of claim 3 wherein the determining of the fluid density in the region over the period comprises analyzing the pressure drop and flow rate in light of a discharge coefficient for the Venturi device.

5. The method of claim 4 wherein the discharge coefficient is between about 0.90 and about 0.99.

6. The method of claim 4 wherein the discharge coefficient and known pressure are values stored at a processor, the processor telemetrically coupled to a capacitance tool and Venturi device for the estimating of the water cut over the range of 0-100%.

7. A method of optimizing hydrocarbon production from a multilateral well, the method comprising:

setting predetermined water cut production parameters for the well;

verifying an initial water cut for an isolated region of a horizontal leg of the well, the initial water cut below about 30%;

establishing a productivity index for the region with the verified initial water cut available;

computing a flow rate in the region for a period from the established production index irrespective of water cut;

determining fluid density in the region over the period from the computed flow rate in the region over the period;

utilizing the fluid density over the period to estimate the water cut over the period across a range of 0-100% in the region; and controlling the amount of production from the region based on the estimated water cut in light of the set predetermined water cut production parameters for the well.

8. The method of claim 7 wherein the isolated region comprises production tubing with an opening adjacent a formation defining the leg, the region isolated relative the formation by isolating packers.

9. The method of claim 8 wherein the controlling of the amount of production from the region comprises one of opening and closing the opening to regulate fluid production through the tubing.

10. The method of claim 9 wherein the opening and closing of the opening is achieved through one of a valve and a sliding sleeve of the tubing.

11. The method of claim 7 wherein the isolated region is a first isolated region and the horizontal leg is a first horizontal leg, the method further comprising:

verifying a second initial water cut for a second isolated region of one of the first horizontal leg and a second horizontal leg, the second initial water cut below about 30%;

establishing a productivity index for the second region with the verified second initial water cut available;

computing a flow rate in the second region for a period from the established production index for the second region irrespective of water cut;

determining fluid density in the second region over the period from the computed flow rate in the second region over the period;

utilizing the fluid density in the second region over the period to estimate the water cut over the period across a range of 0-100% in the second region; and controlling the amount of production from the second region based on the estimated water cut in the second region in light of the set predetermined water cut production parameters for the well.

12. The method of claim 11 wherein the controlling of the amount of production from the second region is further in light of the controlled amount of production from the first region.

13. The method of claim 7 further comprising storing the predetermined water cut production parameters at a processor housed in one of a control unit located at a surface of an oilfield accommodating the well and an electronics package located downhole in the well.

14. The method of claim 13 wherein the processor is telemetrically coupled to a water cut monitoring system independently isolated within the region.

15. The method of claim 14 wherein the water cut monitoring system is configured to obtain the initial water cut below about 30% with a capacitance tool thereof and the processor is configured to establish the productivity index for the region with the aid of a Venturi device of the system, the processor further configured for the computing of the flow rate, the determining of the fluid density, and the estimating of the water cut across the range of 0-100%.

16. A water cut monitoring system for locating in a region of a well and coupling to a processor to estimate water cut in the region over a range of 0-100%, the system comprising:

a capacitance tool located in the region for acquiring initial water cut information relative the region for use by the processor, the measurement below about 30%; and a Venturi device located in the region of the well for providing flowing pressure information to the processor to aid in establishing a productivity index for the region, the processor to estimate the water cut over the range of 0-100% with the information from the capacitance tool and the Venturi device.

17. The water cut monitoring system of claim 16 wherein the region is a first isolated region of the well, the well having a second isolated region.

18. The water cut monitoring system of claim 17 wherein the well is a multilateral well and the second isolated region is configured to accommodate another water cut monitoring system.

19. The water cut monitoring system of claim 18 wherein the processor is configured to independently acquire and analyze information from both the water cut monitoring system in the first isolated region and the other water cut monitoring system in the second isolated region.

20. The water cut monitoring system of claim 19 wherein the independently acquired and analyzed information from the isolated regions is available for optimizing production from the well.

* * * * *